United States Patent [19]

Pätzold et al.

[11] Patent Number: 4,484,372

[45] Date of Patent: Nov. 27, 1984

[54] FLOOR-SWEEPING MACHINE

[75] Inventors: Dieter Pätzold, Nassau; Alfons Schreiber, Wuppertal; Peter Tiwi, Nassau, all of Fed. Rep. of Germany

[73] Assignee: ITT Industries, Inc., New York, N.Y.

[21] Appl. No.: 422,980

[22] PCT Filed: Jan. 7, 1982

[86] PCT No.: PCT/DE82/00005

§ 371 Date: Sep. 8, 1982

§ 102(e) Date: Sep. 8, 1982

[87] PCT Pub. No.: WO82/02331

PCT Pub. Date: Jul. 22, 1982

[30] Foreign Application Priority Data

Jan. 9, 1981 [DE] Fed. Rep. of Germany ..... 3100372

[51] Int. Cl.[3] ..... A47L 11/33; A47L 11/40

[52] U.S. Cl. ..... 15/42; 15/392

[58] Field of Search ..... 15/42, 41, 43, 44, 45, 15/46, 48, 49 C, 50 C, 383, 392

[56] References Cited

U.S. PATENT DOCUMENTS

| | | | |
|---|---|---|---|
| 1,822,522 | 9/1931 | Goldberg | 15/392 |
| 2,226,581 | 12/1940 | Richardson | 15/41 R |
| 2,962,740 | 12/1960 | Plantholt | 15/45 |
| 3,651,529 | 3/1972 | Dopeil et al. | 15/41 R X |
| 4,357,727 | 11/1982 | McDowell | 15/41 R |

FOREIGN PATENT DOCUMENTS

| | | |
|---|---|---|
| 2049835 | 6/1971 | Fed. Rep. of Germany . |
| 638541 | 6/1950 | United Kingdom . |

*Primary Examiner*—Edward L. Roberts

*Attorney, Agent, or Firm*—John T. O'Halloran; Peter R. Ruzek; Mary C. Werner

[57] ABSTRACT

Floor-sweeping machine consisting of a housing with a revolving brush which is mounted rotatably therein and which can be driven by means of running wheels projecting from the under side of the housing, and in which, for the purpose of rapid assembly and removal, the revolving brush 14 is mounted rotatably by means of two bearing clasps 19 which engage on its ends and which each have a bearing receptacle 24 for the associated bearing end of the revolving brush 14, and the bearing clasps 19 are themselves retained by securely positioned clamping onto housing parts 23.

10 Claims, 7 Drawing Figures

FLOOR-SWEEPING MACHINE

Figure 1:
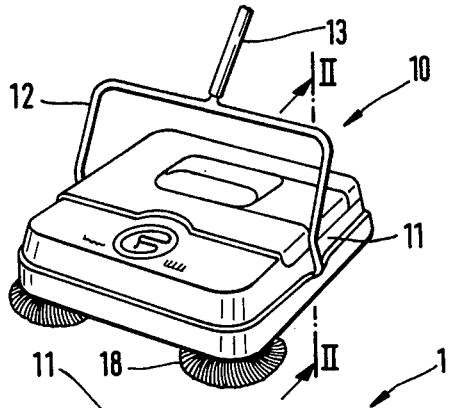

The invention relates to a floor-sweeping machine consisting of a housing with a revolving brush which is mounted rotatably therein and which can be driven by means of running wheels projecting from the underside of the housing.

In this known floor-sweeping machine, the revolving brush has in its two ends bearing bores for bearing journals. Each bearing journal is retained on a respective fastening plate, the fastening plate being screwed to the outer side of the housing wall of the floor-sweeping machine. The bearing journal passes through a perforation in the housing wall of the floor-sweeping machine and engages into the bearing bore of the revolving brush. When the revolving brush is assembled, it first has to be inserted into the housing of the floor-sweeping machine, and then the bearing journal has to be inserted through the perforation in the housing wall and introduced into the bearing bore of the revolving brush. Subsequently, the fastening plate of the bearing journal then has to be screwed to the outer side of the housing wall. Assembly of the floor-sweeping machine and even replacement of the revolving brush are therefore very complicated.

The object on which the invention is based is to provide a floor-sweeping machine of the type explained in the introduction, in which such disadvantages are avoided and the revolving brush can be assembled and removed simply and quickly.

This object is achieved, according to the invention, due to the fact that the revolving brush is mounted rotatably by means of two bearing clasps which engage at its ends and which each have a bearing receptacle for the associated bearing end of the revolving brush, and the bearing clasps are themselves retained by securely positioned clamping onto housing parts. As a result, assembly of the revolving brush is simplified in a simple way, since only the two bearing clasps, together with the revolving brush located between them, have to be clamped onto housing parts by simple attachment.

The bearing clasp can have, for the associated bearing end of the revolving brush, a tubular bearing receptacle for attachment onto the cylindrical bearing end. Because of this, the two bearing clasps can be attached onto the bearing ends of the revolving brush in an especially simple way, a reliable rotatable mounting of the revolving brush in the bearing clasps being achieved.

The cylindrical bearing end of the revolving brush can be formed by an offset projection of a pinion which is provided on the revolving brush and which is drive-connected to the running wheels. As a result, the cylindrical bearing end of the revolving brush is formed, in a simple way, by an offset projection of a pinion which is present, in any case, for the drive connection of the revolving brush to the running wheels.

The bearing clasp can be formed by an approximately U-shaped clamp made of spring steel and can be attached frictionally by means of the two legs of the U-shaped clamp onto a downwardly directed wall part of the housing. As a result, the bearing clasp can be fastened in an especially simple way to the downwardly directed wall part of the housing, since the approximately U-shaped clamp consisting of spring steel merely has to be attached to the downwardly directed wall part by means of its two legs, the two legs resting frictionally against the sides of the wall part located between them.

The approximately U-shaped clamp forming the bearing clasp can have the shaped-on tubular bearing receptacle on the inner side of one leg, whilst the second leg is provided, for passage of the bearing receptacle, with a cut-out portion starting from its free end. Because of this, the tubular bearing receptacle is shaped on one leg of the approximately U-shaped clamp in a simple way, which results in simple production being achieved. The tubular bearing receptacle extends through the gap between the two legs, so that less room is taken up for the tubular bearing receptacle.

The leg of the approximately U-shaped clamp which has the tubular bearing receptacle can rest by means of its outer side against an annular shoulder formed by the offset projection of the pinion. As a result, the revolving brush is also secured, in a simple way, against axial displacement in the two bearing clasps.

The leg having the cut-out portion for the passage of the bearing receptacle can have, at its free end, angled portions directed obliquely outwards to form an introduction slope. By means of this introduction slope formed by angled portions directed obliquely outwards, it becomes easier to attach onto the wall part of the housing the approximately U-shaped clamp forming the bearing clasp.

The distance between the two legs of the approximately U-shaped clamp can decrease somewhat from the crown part to the free ends of the leg. Because of this, when the U-shaped clamp is attached, the legs are spread somewhat, so that they come to rest with prestress against the sides of the wall part.

The leg of the approximately U-shaped clamp which has the tubular bearing receptacle can be somewhat longer than the second leg and can have, at its free end, a rectangular angled portion directed inwards for engagement into a cut-out portion of the housing wall engaging into the clamp. As a result of the engagement of this inwardly directed rectangular angled portion in a cut-out portion of the housing wall, the approximately U-shaped clamp is prevented from being pulled off from the wall part of the housing.

The inwardly directed rectangular angled portion of the first leg of the clamp can rest, by means of its side face directed towards the crown part, against an offset shoulder of the housing wall. As a result, the U-shaped clamp is secured against being pulled off.

After being clamped onto the wall part of the housing by means of the tubular bearing receptacle, the bearing clasp can rest against the end wall of a downwardly open cut-out portion of the wall part of the housing. As a result of this engagement of the tubular bearing receptacle of the bearing clasp into the downwardly open cut-out portion of the wall part of the housing, the bearing clasp is secured against lateral displacement and against being pushed in further.

The approximately U-shaped clamp forming the bearing clasp can have, in its crown part, a perforation for inserting a screwdriver or the like serving to spread open the legs of the clamp. By inserting the screwdriver into the perforation in the crown part of the bearing clasp, the legs can be spread open and the bearing clasp can thus be removed from the wall part of the housing. Consequently, it is also possible, in a simple way, to take out the revolving brush in order to exchange it.

Figure 2:
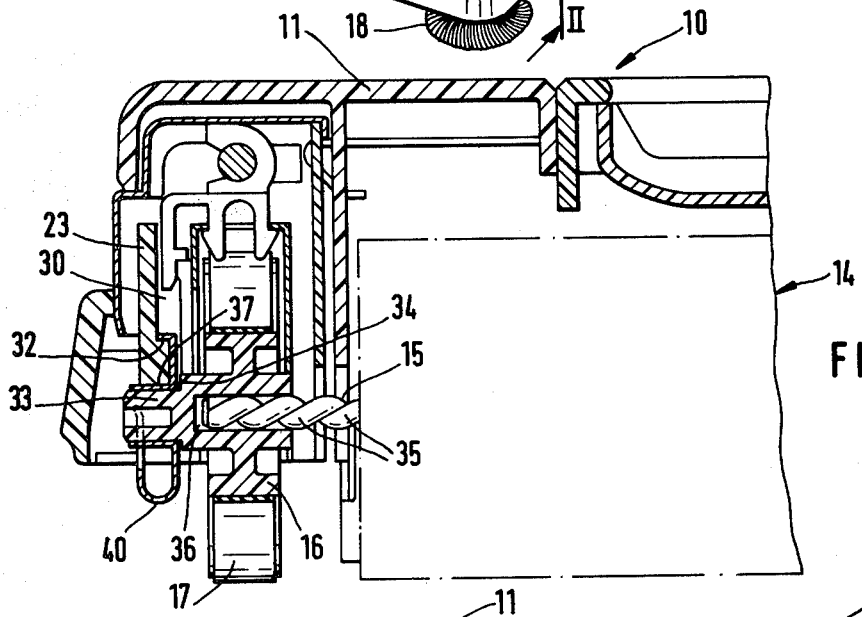
Figure 3:
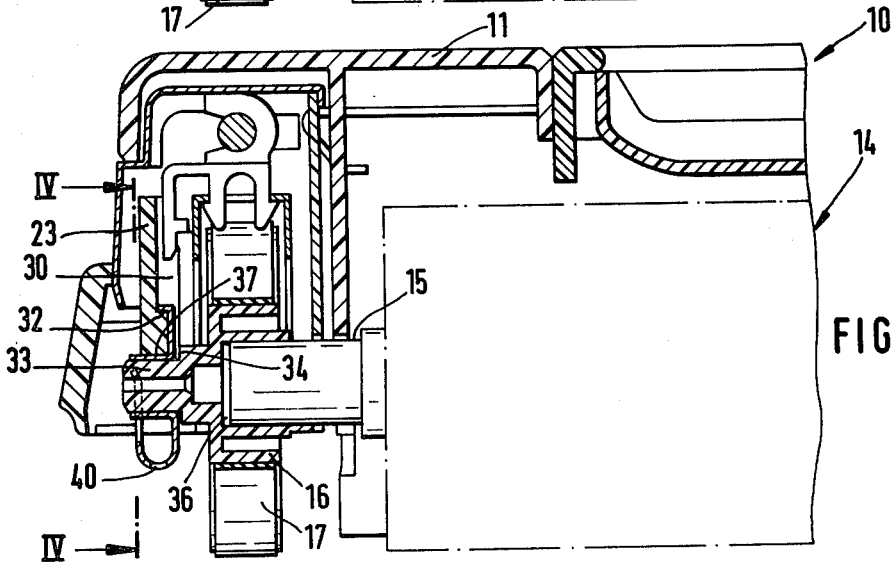
Figure 4:
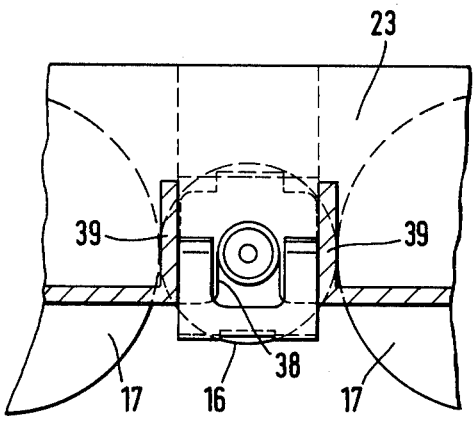
Figure 7:
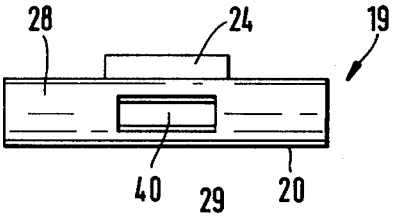
Figure 6:
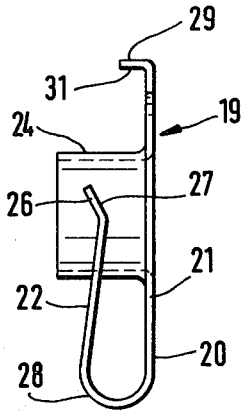
Figure 5:
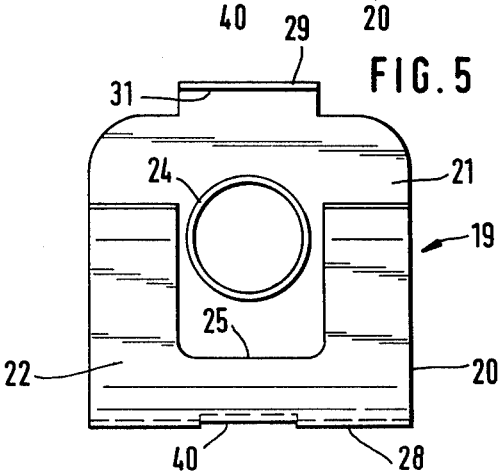

The invention is illustrated in an examplary embodiment in the drawing in which:

FIG. 1 shows, in a graphical representation, a floor-sweeping machine according to the invention, FIG. 2 shows a section along the line II—II of FIG. 1, FIG. 3 shows a section corresponding to FIG. 2, through a floor-sweeping machine with another revolving brush, FIG. 4 shows a section along the line IV—IV of FIG. 3, FIG. 5 shows the bearing clasp in a front view, FIG. 6 shows the bearing clasp in a side view, FIG. 7 shows the bearing clasp in a bottom view.

The floor-sweeping machine 10 illustrated in the drawing consists of a housing 11. The outer side of the housing 11 serves for receiving a stick fork 12 to which is fastened, in turn, a stick-like handle 13 for moving the floor-sweeping machine to and fro over the floor to be cleaned. On the inside of the appliance, the housing 11 serves for receiving sweeping brushes and the running wheels serving for moving the appliance over a floor surface and for driving the sweeping brushes. To pick up dirt from the floor to be cleaned by the floor-sweeping machine, there is, first of all, a revolving brush 14 which extends transversely to the envisaged direction of movement. To rotate the revolving brush 14 with respect to the floor to be cleaned, pinions 16 are assigned to this at the ends of the axle 15 and are connected operatively to running drive wheels 17 by friction. Hence, the running drive wheels 17 are mounted in the housing 11 in pairs.

Since the revolving brush 14 can work with a sweeping action only up to a certain distance from the side-wall regions of the floor-sweeping machine 10, additional brushes 18 are provided for covering the side-wall regions and, by means of these, the side regions located outside the effective range of the revolving brush 14 can also be covered, as a result of which complete cleaning of the floor even along steps and walls and in corner regions becomes possible.

In the exemplary embodiment illustrated, an additional brush 18 is located in each of the front corner regions of the floor-sweeping machine 10, in such a way that they are rotatable about a substantially vertical axis and, by means of their bristle rim arranged in the form of a cup, that is to say radially outwards and downwards, overlap the effective range of the revolving brush 14, on the one hand, and the side-wall and front-wall region of the housing 11, on the other hand. For the purpose of rotation effective for sweeping, the two additional brushes 18 are drive-coupled to running drive wheels located between them and not shown in any more detail.

For the rotatable mounting of the revolving brush 14 in the housing 11 there are two bearing clasps 19 which engage respectively on the ends of the revolving brush 14. The bearing clasp 19 is formed by an approximately U-shaped clamp 20 made of spring steel and can be attached frictionally by means of the two legs 21, 22 of the U-shaped clamp 20 onto a downwardly directed wall part 23 of the housing 11.

The approximately U-shaped clamp 20 forming the bearing clasp 19 has, on the inner side of one leg 21, a shaped-on tubular bearing receptacle 24. The second leg 22 of the approximately U-shaped clamp 20 is provided, for the passage of the bearing receptacle 24, with a cut-out portion 25 starting from its free end. The leg 22 having the cut-out portion 25 for the passage of the bearing receptacle 24 has, at its free end, angled portions 26 directed obliquely outwards to form an introduction slope 27. By means of this introduction slope 27, it becomes easier to attach the bearing clasp 19 onto the downwardly directed wall part 23 of the housing 11.

The distance between the two legs 21, 22 of the approximately U-shaped clamp 20 decreases somewhat from the crown part 28 to the free ends of the legs 21, 22. As a result, the two legs 21, 22 rest with pre-stress against the downwardly directed wall part 23 of the housing 11.

The leg 21 of the approximately U-shaped clamp 20 which has the tubular bearing receptacle 24 is somewhat longer than the second leg 22 and has, at its free end, a rectangular angled portion 29 directed inwards for engagement into a cut-out portion 30 of the housing wall 23 engaging into the clamp 20. Thus, the bearing clasp 19 is prevented, in a simple way, from being released inadvertently.

The inwardly directed rectangular angled portion 29 of the first leg 21 of the clamp 20 rests, by means of its side face 31 directed towards the crown part 28, against an offset shoulder 32 of the housing wall 23. The offset shoulder 32 is formed, here, by the cut-out portion 30. As a result, the bearing clasp 19 is retained on the wall part 23 of the housing 11 in a way which secures it against being pulled off.

During assembly of the revolving brush 14, the two bearing clasps 19 must be attached onto the ends of the revolving brush 14. For this purpose, the revolving brush 14 has offset projections 33 on the pinions 16. The offset projections 33 of the pinions 16 thus form cylindrical bearing ends which engage into the bearing receptacles 24 of the bearing clasp 19. The revolving brush 14 is consequently retained rotatably in the two bearing clasps 19. The two bearing clasps 19 are then pressed, together with the revolving brush 14 located therein, onto the wall parts 23 of the housing 11. Assembly is therefore very simple.

The leg 21 of the approximately U-shaped clamp 20 which has the tubular bearing receptacle 24 rests by means of its outer side against an annular shoulder 34 formed by the offset projection 33 of the pinion 16, so that the revolving brush 14 is also secured against axial displacement. In the exemplary embodiment illustrated in FIG. 2, the axle 15 of the revolving brush 14 consists of two wires 35 twisted together, between which the bristles, not shown in any more detail, are clamped. The free ends of the wires 35 twisted together engage into a cut-out portion 36 of the pinion 16. In the exemplary embodiment illustrated in FIG. 3, the axle 15 is made of wood, and individual bristle tufts, not shown in any more detail, are inserted into this. The free end of the wooden axle 15 is also inserted into a cut-out portion 36 of the pinion 16.

After being clamped onto the wall part 23 of the housing 11 by means of the tubular bearing receptacle 24, the bearing clasp 19 rests against the end wall 37 of a downwardly open cut-out portion 38 of the wall part 23 of the housing 11. As a result, the bearing clasp 19 is also prevented, in a simple way, from slipping sideways after being attached onto the downwardly directed wall part 23 of the housing 11. In addition, the downwardly directed wall part 23 of the housing 11 also has lateral ribs 39 which come to rest against the sides of the bearing clasp 19.

The approximately U-shaped clamp 20 forming the bearing clasp 19 has, in its crown part 28, a perforation 40 for inserting a screwdriver or the like serving for spreading open the legs 21, 22 of the clamp. Because the legs 21, 22 of the clamp are spread open by a screwdriver or the like, it is possible, in a simple way, to detach the bearing clasp 19 and consequently remove the revolving brush 14.

As already mentioned, the design shown is merely one example of putting the invention into practice and the latter is not restricted to this. Instead, many other designs and applications are possible.

We claim:

1. In a floor-sweeping machine of the type including a housing having two lateral portions, means for supporting said housing for movement on a surface to be cleaned and means for moving said housing, the combination comprising:

cylindrical brush means having end portions; and means for removably mounting said brush means on said housing for rotation about a horizontal axis including at least one mounting unit for mounting one of said end portions, on the respective lateral portion of the housing, said unit including a resilient substantially U-shaped element slidable onto said respective lateral portion and having a first and a second leg which embrace said lateral portion and each of which frictionally engages said lateral portion to retain said U-shaped element in a mounted position on said housing, and a tubular receptacle secured to said first leg which faces towards said brush means in the mounted position of said U-shaped element and centered on said axis in the mounted position of said U-shaped element to receive said one end portion of said brush means for rotation about said axis.

2. The floor-sweeping machine according to claim 1 wherein each of said end portions includes a pinion connected to said moving means, and having an offset projection which is mounted in said tubular receptacle.

3. The floor-sweeping machine according to claim 2 wherein said first leg of said U-shaped element has an outer side which faces towards said brush means and wherein said offset projection has a shoulder portion adjacent said outer side for preventing axial displacement of said brush means when in a mounted position.

4. The floor-sweeping machine according to claim 1 wherein said second leg of said U-shaped element has end sections which bound a substantially U-shaped cut-out portion.

5. The floor-sweeping machine according to claim 4 wherein said end sections of said second leg have outwardly angled extensions which form an introduction slope for receiving said housing.

6. The floor-sweeping machine according to claim 1 wherein the distance between said first and said second legs of said U-shaped element decreases from the lower end to the upper end of said element.

7. The floor-sweeping machine according to claim 1 wherein the lower portion of said U-shaped element bounds an opening through which means may be inserted for releasing said mounting unit from said housing.

8. In a floor-sweeping machine of the type including a housing, means for supporting said housing for movement on a surface to be cleaned and means for moving said housing, the combination comprising:

cylindrical brush means having end portions; and means for removably mounting said brush means about a horizontal axis including at least one mounting unit for one of said end portions, which includes a resilient substantially U-shaped element having a first and a second leg clamping a part of said housing therebetween to frictionally retain said U-shaped element in a mounted position on said housing, said first leg being longer than said second leg and having an angled end portion extending in a direction away from said brush means and wherein the inner surface of said housing has a recessed portion into which said angled end portion extends, and a tubular receptacle secured to said first leg which faces towards said brush means in the mounted position of said U-shaped element and centered on said axis in the mounted position of said U-shaped element to receive said one end portion of said brush means for rotation about said axis.

9. The floor-sweeping machine according to claim 8 wherein said first leg has an inner surface and wherein said inner surface of said housing has an offset shoulder extending from said recessed portion against which said inner surface of said first leg rests.

10. The floor-sweeping machine according to claim 9 wherein said housing has a lower portion which bounds an opening through which the tubular receptacle is positioned when in a mounted position.

* * * * *